US008465821B2

(12) United States Patent
Boucke

(10) Patent No.: US 8,465,821 B2
(45) Date of Patent: Jun. 18, 2013

(54) FLOOR PANEL WITH A FIRE-RESISTANT COATING

(75) Inventor: Eddy Boucke, Menen (BE)

(73) Assignee: Berry Finance N.V. (BE)

( * ) Notice: Subject to any disclaimer, the term of this patent is extended or adjusted under 35 U.S.C. 154(b) by 1116 days.

(21) Appl. No.: 12/096,757

(22) PCT Filed: Mar. 3, 2006

(86) PCT No.: PCT/EP2006/001982

§ 371 (c)(1),
(2), (4) Date: Oct. 7, 2008

(87) PCT Pub. No.: WO2007/065481

PCT Pub. Date: Jun. 14, 2007

(65) Prior Publication Data

US 2009/0214832 A1 Aug. 27, 2009

(30) Foreign Application Priority Data

Dec. 7, 2005 (EP) ..... 05026745

(51) Int. Cl.
*E04B 1/94* (2006.01)
*E04F 15/02* (2006.01)

(52) U.S. Cl.
USPC ..... 428/50; 428/48; 428/53; 428/192; 428/193; 428/920; 428/921

(58) Field of Classification Search
USPC ..... 428/192, 193, 194, 446, 452, 453, 428/454, 920, 921, 50, 44, 47, 48; 427/421.1, 427/427
See application file for complete search history.

(56) References Cited

U.S. PATENT DOCUMENTS

| | | | | |
|---|---|---|---|---|
| 2,689,472 | A * | 9/1954 | Robertson | 52/440 |
| 3,915,777 | A * | 10/1975 | Kaplan | 156/202 |
| 4,027,444 | A * | 6/1977 | Berg | 52/240 |
| 4,035,967 | A * | 7/1977 | Harvey | 52/126.6 |
| 4,066,763 | A * | 1/1978 | Demerson et al. | 514/224.5 |
| 4,136,147 | A * | 1/1979 | Wheeler | 264/261 |
| 5,035,951 | A * | 7/1991 | Dimanshteyn | 428/446 |
| 6,084,008 | A * | 7/2000 | Liu | 523/179 |
| 6,510,807 | B2 * | 1/2003 | Gottfried | 114/78 |
| 6,989,113 | B1 * | 1/2006 | Mabey | 252/606 |
| 7,763,143 | B2 * | 7/2010 | Boucke | 156/304.5 |
| 7,811,489 | B2 * | 10/2010 | Pervan et al. | 264/115 |

(Continued)

FOREIGN PATENT DOCUMENTS

| | | | |
|---|---|---|---|
| CN | 201686623 U | * | 12/2010 |
| DE | 4304079 C1 | * | 5/1994 |

(Continued)

*Primary Examiner* — Cheryl Juska
(74) *Attorney, Agent, or Firm* — David I. Roche; Baker & McKenzie LLP

(57) ABSTRACT

A floor panel with a coating structure is described, said floor panel has improved fire protection properties. For this purpose, a fire-resistant layer is built into to layered structure of the panel and a coating is provided along the edges of the panel.

7 Claims, 2 Drawing Sheets

U.S. PATENT DOCUMENTS

2002/0100404 A1* 8/2002 Gottfried ..... 114/78
2002/0160680 A1 10/2002 Laurence
2003/0022577 A1 1/2003 Kim et al.
2005/0166515 A1* 8/2005 Boucke ..... 52/589.1
2006/0090414 A1* 5/2006 Ye ..... 52/578
2008/0115442 A1* 5/2008 Cheng ..... 52/506.1
2009/0039660 A1* 2/2009 Gonzalez ..... 292/342
2009/0072086 A1* 3/2009 Smith et al. ..... 244/119
2009/0101236 A1* 4/2009 Boucke ..... 144/350
2009/0155612 A1* 6/2009 Pervan et al. ..... 428/498
2009/0183457 A1* 7/2009 Boucke ..... 52/425
2009/0242217 A1* 10/2009 van de Loenhorst ..... 169/46
2009/0252927 A1* 10/2009 Gonzalez ..... 428/156
2010/0223878 A1* 9/2010 Lipka et al. ..... 52/741.3
2011/0005641 A1* 1/2011 Dengyun et al. ..... 144/335
2011/0045280 A1* 2/2011 Varma et al. ..... 428/332

FOREIGN PATENT DOCUMENTS

EP 1493878 A 1/2005
EP 1593791 A 11/2005
EP 2060389 A1 * 5/2009
GB 1570218 A * 6/1980
GB 2053798 A 2/1981
JP 02024432 A * 1/1990
JP 06010426 A * 1/1994
JP 07259212 A * 10/1995
JP 08158754 A * 6/1996
JP 2000272729 A * 10/2000

* cited by examiner

FLOOR PANEL WITH A FIRE-RESISTANT COATING

This U.S. Application is a National Stage Application based on PCT/EP2006/001982, which has an International Filing Date of Mar. 3, 2006, published as WO 2007/065481.

BACKGROUND OF THE INVENTION

The invention relates to a floor panel with a layer structure.

A large number of floor panels composed of layers, so-called laminate floorings, is known. In most cases, they consist of a core of a compression-proof wood material plate (HDF or MDF), a leveling layer, a layer of a decorative paper, and an upper wear-resistant layer which often consists of a cured, extremely durable lacquer or resin. The fire-resistance of these floor panels, however, is insufficient.

Therefore, the object underlying the invention is to provide a floor panel with an increased resistance to fire.

The object is achieved by various combinations of the features described herein below.

By the inventive fire-resistant layer, a floor panel with improved fire-resistance is provided in a simple manner.

Advantageously, the fire-resistant layer consists of a non-flammable material, possibly, however, a hardly inflammable material can also be employed.

A preferred material for the fire-resistant layer is a fiber mat, in particular a glass fiber mat. The glass fiber mat has the further advantage of increasing the impact strength of the floor panel.

If the fire-resistant layer is provided with an impregnation of a binder, the connection to adjacent layers is improved. A preferred impregnation agent is melamine resin which is usually employed to connect the layers of floor panels to each other.

In the layer structure of the floor panel, the fire-resistant layer is arranged as near as possible to the upper side as in the majority of cases the fire load acts from this side. A preferred arrangement of the fire-resistant layer is accordingly between a decorative layer and a core.

The fire-resistant layer should be sufficiently thick to display its fire-resistant effect. A thickness of between 0.01 and 3 mm is preferred.

The floor panel according to the invention only requires insignificant changes of the manufacturing process, as the fire-resistant layer provided according to the invention can be easily pressed together with other layers to form a floor panel.

The fire-resistant properties of the floor panel can be further improved if the edge of the floor panel is designed to be fire-resistant. This is preferably achieved by applying a fire-resistant layer, for example of a mixture of kaolin and sodium silicate.

Below, one embodiment of the invention will be illustrated more in detail with reference to the drawings. In the drawings:

DETAILED DESCRIPTION OF THE INVENTION

Figure 1:
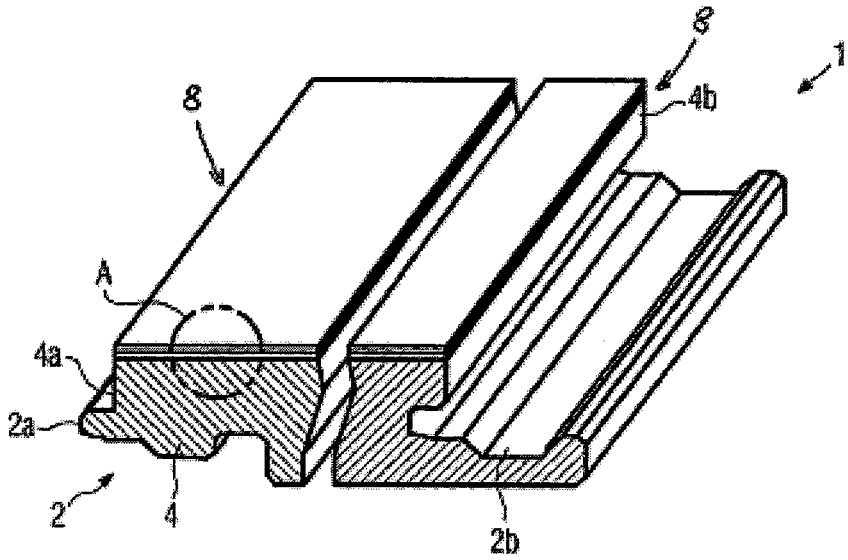
FIG. 1 shows a schematic, perspective partial representation of a floor panel according to the invention.
Figure 2:
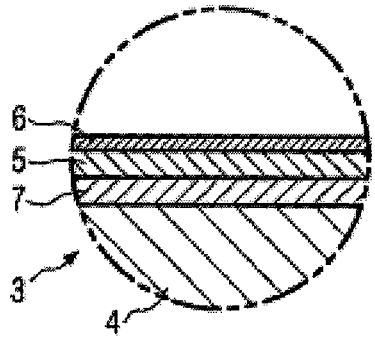
FIG. 2 shows the enlarged detail A of FIG. 1.

FIG. 1 shows a floor panel 1 equipped according to the invention. The outer shape and design of the floor panel is arbitrary, the floor panel 1 can be, for example, provided as board or plate. The floor panel 1 according to the invention is, in the represented embodiment, formed as rectangular plate which is provided with a mechanical locking system 2 at least two opposite sides. In the represented embodiment, the locking system 2 contains a first profile 2*a* and a corresponding second profile 2*b* each of which extends along opposite longitudinal edges of the floor panel 1 and are formed such that the first profile 2*a* of a floor panel and the second profile 2*b* of an adjacent other floor panel can be connected to each other in a suited manner, such that the floor panels 1 are locked in the floor bond horizontally as well vertically. A great number of such mechanical locking profiles is known, and the invention is neither restricted to the special construction of the locking profiles nor to the special construction of any connection elements between the individual floor panels 1. The invention can rather be designed without any locking systems at the edges, in case of the represented mechanical locking systems as well as in case of locking systems without horizontal locking mechanism, such as, for example, groove and tongue boards, and in case of floor panels or plates. Furthermore, the locking systems can comprise, as represented, profiles at two opposite sides, or else at all sides of the floor panel.

The floor panel 1 is preferably a so-called laminate and contains a layer structure 3. The layer structure 3 comprises a core 4 which is preferably a wood material plate of higher tensile strength, such as, for example, an HDF or MDF plate. The core, however, can also consist of other materials known for the manufacture of floor panels. The layer structure 3 furthermore contains a decorative layer 5. The decorative layer 5 in most cases consists of a layer of paper or another material which comprises a printed or otherwise created decoration. As decorative layer for the floor panel 1 of the present invention, any decorative layer known in prior art can be provided. The decorative layer 5 is preferably covered by a protective layer 6. As protective layer 6 for the floor panel 1 of the present invention, any known protective layer for floor panels can be employed, such as, for example, a resistant lacquer or resin layer.

The layer structure 3 of the floor panel 1 according to the invention furthermore contains a fire-resistant layer 7. The fire-resistant layer 7 consists of a material which is suited to inhibit the inflammation of the side of the panel facing away from the fire, i.e., depending on the action of the fire, to either prevent it or highly retard it. Thanks to the fire-resistant layer 7, the floor panel 1 can be classified in a higher fire protection class (e.g. acc. to DIN EN13051-1) than would be the case with a floor panel without the layer 7, but otherwise having the same structure. Preferably, the fire-resistant layer 7 consists of a non-flammable material. The fire-resistant layer 7 can be present as mat (woven or nonwoven) of fibers, such as, for example, glass fibers. The thickness of the fire-resistant layer 7 can be adapted to the special purpose of application and/or the desired fire protection classification and/or the materials used and is preferably between 0.01 and 3 mm, in particular preferred between 0.05 to 1 mm. Particularly preferred, a glass fiber mat having the following features is employed as fire-resistant layer 7.

TABLE 1

Product Features and Test Methods

| Property | | Reference to test method | Unit | Specification (nominal) |
|---|---|---|---|---|
| Grammage | | ISO 536 | g/m2 | 50 |
| Ignition loss | | ISO 1887 | % | 22 |
| Tensile strength | md | ISO 1924/2 | N/50 mm | >190 |
| | .cmd | | N/50 mm | >160 |
| Air porosity | | at 100 Pa | $l/m^2/S$ | 2000 |

The product consists of glass fibers with a nominal length of 6 mm and a nominal diameter of 10 to 11 μm. The glass fiber mat is bound with polyvinyl alcohol.

The fire-resistant layer 7 is arranged in the layer structure 3 as near to the top as possible, i.e. as near as possible to the side of the floor panel 1 which faces the room where the floor panel 1 is laid. In the represented embodiment, the fire-resistant layer 7 is situated between the decorative layer 5 and the core 4, and is separated from the room where the floor panel 1 is to be laid only by the covering layer 6 and the decorative layer 5 which are both relatively thin. In this manner, the thick, combustible core 4 is optimally shielded against a fire in the room where it was laid.

The fire-resistant layer 7 extends across the complete width of the core 4 and always ends at front sides, only the opposed front sides 4*a*, 4*b* of the core 4 which abut against corresponding front sides of the adjacent floor panels in the finished floor covering are represented, so that a fire resistant-layer 7 which continuously extends across the floor covering is formed.

Figure 3:
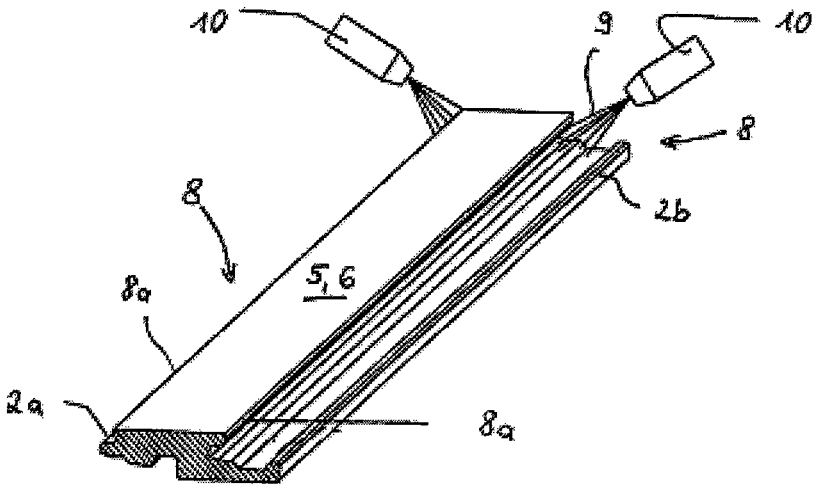
FIG. 3 shows a representation of an edge protection method.

As is shown in FIG. 3, the fire-resistant embodiment of the floor panel can even be improved in that at least areas of the edges 8 of the floor panel are designed to be fire-resistant (fire-retarding or fireproof). The edges 8 are the side faces of the floor panel which extend around the circumference of the floor panel and have an essentially vertical orientation in the finished floor covering. The edges 8 in particular contain an abutting edge area 8*a* directly following the covering and decorative layers 5, 6, respectively, and preferably extending perpendicularly thereto. The abutting edge areas 8*a* adjoin corresponding abutting edge areas of adjacent panels in the finished floor covering. The edge 8, however, still contains the profiles 2*a*, 2*b* of the connection system which can also comprise areas comprising a horizontal or diagonal orientation.

To improve the fire-resistant embodiment in the abutting area between adjacent panels, i.e. to prevent the flames from penetrating the butt joint between adjacent panels where they could bypass the fire-resistant layer, the edge 8 preferably has a fire-resistant design. This is achieved by a fire-resistant coating 9 which is at least in some areas applied to the edge 8, preferably around the floor panel 1. The coating should in any case cover that area of the edge 8 which faces the direction of the presumed fire load, i.e. the abutting edge area 8*a*. It is, however, preferred for the coating 9 to be also applied to other areas of the edge 8, in particular also to the surfaces of the connection profiles 2*a*, 2*b* facing upwards, i.e. towards the covering and decorative layers 5, 6, and to all other areas following the abutting edge area 8*a*. In case of edges 8 that are not provided with connection profiles, it is preferred for the coating 9 to cover the complete edge of the decorative and covering layers 5, 6 down to the bottom side. But also at edges 8 exhibiting a connection profile 8, safety as regards a penetration of the flames is increased if all areas of the edge 8 are provided with the coating 9.

The coating 9 is preferably present as a more or less viscous liquid, so that it can be applied by spraying or spray-coating, spreading, rolling or other coating methods. In the represented embodiment, the coating 9 is applied by means of two spray nozzles 10 which are directed to the edge 8 diagonally from above, so that the coating 9 is applied in a direction approached to the direction of the action of the fire, so that it can be ensured that all areas of the edge 8 possibly exposed to the action of the fire are also covered with the coating agent 9.

Any known fire-resistant agent which can be applied in a free-flowing form is suited as coating agent. Preferably, the coating agent 9 contains a mixture of kaolin and sodium silicate in aqueous solution. Kaolin as well as sodium silicate are commercially available and can be employed in a commercially available purity and composition. The coating amount per unit of area depends on the absorbency of the substrate and on other factors, and it can be easily determined by trial. Principally, however, any material can be employed for edge coating which comprises fire-resistance complying with the standards (for example EN 13501-1 or EN ISO 9239-1), even with a relatively thin layer thickness (so that the butt between adjacent panels in the floor covering is not too large and not disturbingly visible).

As modification to the described and drawn embodiment, the floor panel 1 can have a different layer structure 3, where, for example, further layers can be provided. For example, at the side of the core facing away from the covering layer 6, in the core or above the core, an impact sound insulation layer can be provided. It is furthermore conceivable to design the fire-resistant layer 7 as decorative layer and/or even as covering layer.

The material for the fire-resistant layer 7 should be preferably selected such that the fire-resistant layer requires as little manufacturing steps as possible, or no additional ones. This is achieved, for example, in that the fire-resistant layer 7 is provided with an impregnation, in particular if a glass fiber mat is employed for it. The impregnation can contain, for example, melamine resin, which is used in the manufacture of floor panels as impregnation agent for the decorative layer. By using the same impregnation agent for the decorative and the fire-resistant layers, it is possible to press the fire-resistant layer 7 together with, for example, the decorative layer 5 with the core 4, by the application of pressure and/or heat. Thereby, no additional fixing step for fixing the fire-resistant layer 7 in the layer structure 3 becomes necessary. The impregnation of the mat, in particular the glass fiber mat, with melamine or any other agent can furthermore lead to an increase of strength (e.g. with respect to denting by large loads applied at points). However, it is also possible to fix the fire-resistant layer in the layer structure by other measures, e.g. by gluing.

The invention claimed is:

1. A floor panel comprising a panel formed as a rectangle and provided with a mechanical locking system on at least two opposite edges of the panel and with a layer structure comprising a decorative layer, a core formed of a wood-based material selected from the group consisting of MDF and HDF and a fire-resistant layer provided in the layer structure between the decorative layer and the core, the fire resistant layer extending the width of the core to opposite edge faces of the panel, and all exposed edges of the panel, without regard to whether said edges are provided with a mechanical locking system, containing a coating of a fire-resistant material, such that a fire-resistant layer is present continuously throughout the panel.

2. A floor panel according to claim 1 wherein the fire-resistant layer contains non-flammable material.

3. A floor panel according to claim 1 wherein the fire-resistant layer contains a fiber mat.

4. A floor panel according to claim 1 wherein the fire-resistant layer contains a glass fiber mat.

5. A floor panel according to claim 1 wherein the fire-resistant layer contains an impregnation.

6. A floor panel according to claim 5 wherein the impregnation contains melamine resin.

7. A floor panel according to claim 1 wherein the fire-resistant layer comprises a thickness of between 0.01 to 3 mm.

* * * * *